US006684579B2

(12) United States Patent
Brunson et al.

(10) Patent No.: US 6,684,579 B2
(45) Date of Patent: Feb. 3, 2004

(54) DRAINAGE MAT AND MORTAR BLOCKER

(75) Inventors: James R. Brunson, Matthews, NC (US); C. Davis Carman, Matthews, NC (US); Michael B. Obermeyer, Charlotte, NC (US)

(73) Assignee: Owens Corning Fiberglass Technology, Inc., Summit, IL (US)

( * ) Notice: Subject to any disclaimer, the term of this patent is extended or adjusted under 35 U.S.C. 154(b) by 10 days.

(21) Appl. No.: 10/041,216

(22) Filed: Jan. 8, 2002

(65) Prior Publication Data

US 2003/0126810 A1 Jul. 10, 2003

(51) Int. Cl.[7] ..... E02B 11/00
(52) U.S. Cl. ..... 52/169.5; 52/169.14; 52/302.3
(58) Field of Search ..... 52/169.5, 169.14, 52/302.3

(56) References Cited

U.S. PATENT DOCUMENTS

| | | | | | |
|---|---|---|---|---|---|
| 3,563,038 | A | * | 2/1971 | Healy et al. | 405/45 |
| 3,654,765 | A | * | 4/1972 | Healy et al. | 405/45 |
| 3,888,087 | A | * | 6/1975 | Bergsland | 405/36 |
| 4,572,700 | A | * | 2/1986 | Mantarro et al. | 404/35 |
| 4,704,048 | A | | 11/1987 | Ahlgrimm | |
| 4,730,953 | A | * | 3/1988 | Tarko | 405/45 |
| 4,840,515 | A | * | 6/1989 | Freese | 405/45 |
| 4,943,185 | A | * | 7/1990 | McGuckin et al. | 405/45 |
| 5,383,314 | A | * | 1/1995 | Rothberg | 52/169.5 |
| 5,598,673 | A | | 2/1997 | Atkins | |
| 5,615,525 | A | | 4/1997 | Kenworthy | |
| 5,692,348 | A | * | 12/1997 | Ambrosino | 52/169.5 |
| 5,857,297 | A | | 1/1999 | Sawyer | |
| 5,860,259 | A | | 1/1999 | Laska | |
| 6,023,892 | A | * | 2/2000 | Sourlis | 52/169.5 |
| RE36,676 | E | | 5/2000 | Sourlis | |
| 6,238,766 | B1 | | 5/2001 | Massett et al. | |
| 6,241,421 | B1 | * | 6/2001 | Harvie et al. | 405/45 |
| 6,279,275 | B1 | | 8/2001 | Sawyer | |

OTHER PUBLICATIONS

The Mortar Net Drainage System: 04082/MOR; BuyLine 9976; Printed in the USA.

* cited by examiner

*Primary Examiner*—Carl D. Friedman
*Assistant Examiner*—Basil Katcheves
(74) *Attorney, Agent, or Firm*—Inger H. Eckert; Stephen W. Barns; Maria C. Gasaway

(57) ABSTRACT

A drainage mat and mortar blocker system including a panel and polymeric drainage mat which includes protrusions on the front side and indentations on the back side of the mat. A filter fabric is affixed to the side of the mat containing the protrusions. The top portion of the back side of the drainage mat is affixed to the panel and the bottom portion of the mat is folded upward so as to form a U-shape. The U-shape is held in place by connections extending from the back side of the bottom portion of the drainage mat and into the front side of the drainage mat.

46 Claims, 5 Drawing Sheets

DRAINAGE MAT AND MORTAR BLOCKER

TECHNICAL FIELD

The present invention relates to a drainage mat and mortar blocker. More particularly, it a drainage mat which acts as a continuous drainage medium and a barrier to construction debris when inserted into a wall cavity.

BACKGROUND

The concept of placing drainage systems and debris inhibiting systems in wall cavities is well-known. For instance, U.S. Pat. No. 5,860,259 illustrates a planar insulating board constructed of an insulated section and a drain structure for use in masonry walls. The insulated section is constructed of extruded or expanded polystyrene and the drain structure is fabricated of a matted material such as strands of polymer, i.e., polyethtylene, nylon or polyester. The drain structure is attached to the insulated section by an adhesive.

U.S. Pat. No. 4,704,048 illustrates a panel assembly inserted on the exterior surface of a wall. The assembly includes an insulating board with channels on one side of the board. A water-pervious fabric is attached to the channelled side of the board. The panel assembly collects water and channels it downward and away from the wall.

U.S. Pat. No. 5,857,297 describes an elastomeric, water-impervious coating which is applied to the outer surface of a foundation wall. Sheets of water-impervious protection board, formed from thermoplastic resin, are then bonded to the elastomeric coating. The proctection boards function to protect the elastomeric coating from damage during backfilling. Further, the protection boards contain holes and channels that serve to facilitate the movement of water downward away from the wall.

U.S. Pat. No. 6,238,766 illustrates a high-strength geomembrane constructed from a blend of polyethylene copolymers. The geomembrane is installed on a foundation wall and serves to protect wall waterproofing systems from impact of debris from backfilling, earth movement and cracks.

U.S. Pat. No. 5,598,673 describes a masonry cavity wall construction which prevents water damage to building foundations and blocks construction debris from entering the cavity. The air space, bewteen the masonry cavity wall and the interior wythe, contains board insulation to which is attached a polymeric fluiding conducting mesh. The mesh allows gases and water to pass through but prevents solid materials, such as construction debris, from passing through it.

U.S. Pat. No. 5,615,525 illustrates a thermoplastic foam board containing channels which extend into the board. The panel is installed on the exterior surface of a foundation wall with the channels abut and open toward the backfill soil. The channels vary in width so as to prevent backfill soil from entering the channels while still providing effective water drainage.

All of the above patents teach methods and apparatus for providing drainage for walls and/or blocking debris from entering wall cavities and/or providing insulation for walls. However, none of the prior art specifically addresses an apparatus for providing wall insulation, water drainage and preventing substantially all debris from blocking the drainage of water from the wall cavity. Further, none of the prior art suggest providing a gap, free of debris, between the interior and exterior wall and below the drain material, to permit water to exit the wall cavity.

None of the prior art teach or suggest a product that utilizes a folded flap that remains out of a contractor's way while he/she constructs an exterior wall. The prior art does not teach or suggest a product that completely blocks the cavity of a wall to permit drainage and collect construction debris. Further, none of the prior art suggest an adjustable product that can be applied to wall cavities that are small in size, i.e., one inch to three inches across.

Thus, there is a need for a drainage mat that provides superior water drainage, debris-blocking capability and insulation in a simple product that can be easily installed in a wall cavity.

SUMMARY

The present invention relates to a method and apparatus to provide insulation, drainage and debris blocking capability. More particularly, the invention relates to a drainage mat and mortar blocker including a panel and polymeric drainage mat which includes protrusions on the front side and indentations, corresponding to the protrusions, on the back side of the mat. A filter fabric is affixed the protrusions. The top portion of the back side of the drainage mat is affixed to the panel and the bottom portion of the mat is folded upward so as to form a U-shape. The U-shape is held in place by connections extending from the back side of the bottom portion of the drainage mat and into the front side of the drainage mat.

It is an object of the present invention to provide an apparatus that provides drainage and debris-blocking capabilities in a single product.

It is an object of the present invention to provide an apparatus that utilizes a folded flap that remains out of a contractor's way while he/she constructs an exterior wall.

It is an object of the present invention to provide an apparatus that completely blocks the cavity of a wall to permit drainage and collect construction debris.

It is an object of the present invention to provide an adjustable product that can be applied to wall cavities that are small in size, i.e., one inch to three inches across.

It is an object of the present invention to provide an apparatus that blocks debris so that the gap at the bottom of a wall cavity is open for drainage.

It is another object of the present invention to provide a drainage and debris-blocking apparatus that is easy to install.

It is a further object of the present invention to provide a drainage and debris-blocking apparatus that may be conveniently installed on an insulation panel.

The foregoing and other advantages of the invention will become apparent from the following disclosure in which one or more preferred embodiments of the invention are described in detail and illustrated in the accompanying drawings. It is contemplated that variations in procedures, structural features and arrangement of parts may appear to a person skilled in the art without departing from the scope of or sacrificing any of the advantages of the invention.

Figure 1:
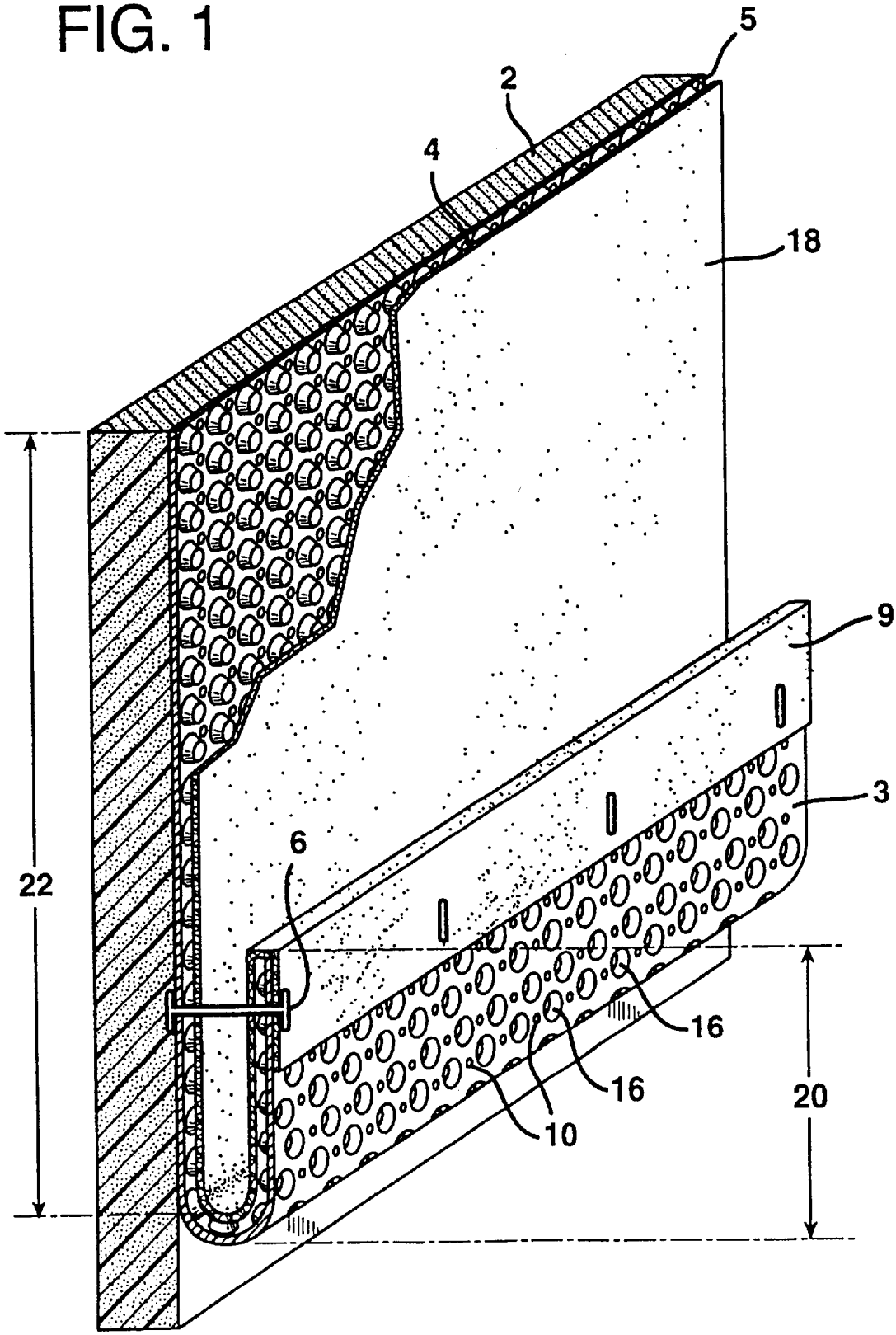
FIG. 1 is a perspective view of the drainage and mortar blocker affixed on an insulation panel.

In describing preferred embodiments of the invention, which are illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

Although preferred embodiments of the invention are herein described, it is understood that various changes and modifications in the illustrated and described structure can be affected without departure from the basic principles that underlie the invention. Changes and modifications of this type are therefore deemed to be circumscribed by the spirit and scope of the invention, except as the same may be necessarily modified by the appended claims or reasonable equivalents thereof.

DETAILED DESCRIPTION OF INVENTION

FIG. 1 is a perspective view of the drainage mat and mortar blocker 4, in accordance with an embodiment of the present invention. The drainage mat and mortar blocker includes a drainage mat 4 and filter fabric 18.

Figure 3:
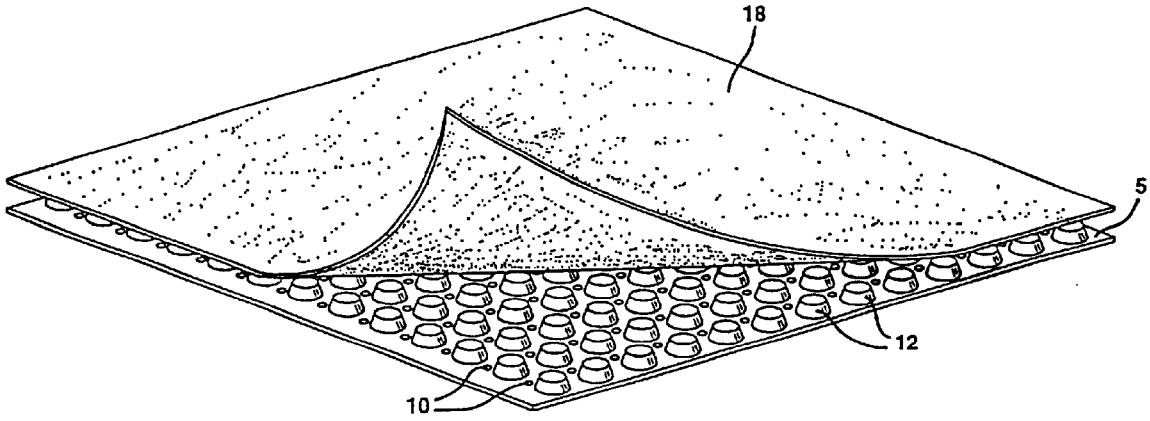
FIG. 3 is a perspective view of the front side of the drainage mat.
Figure 4:
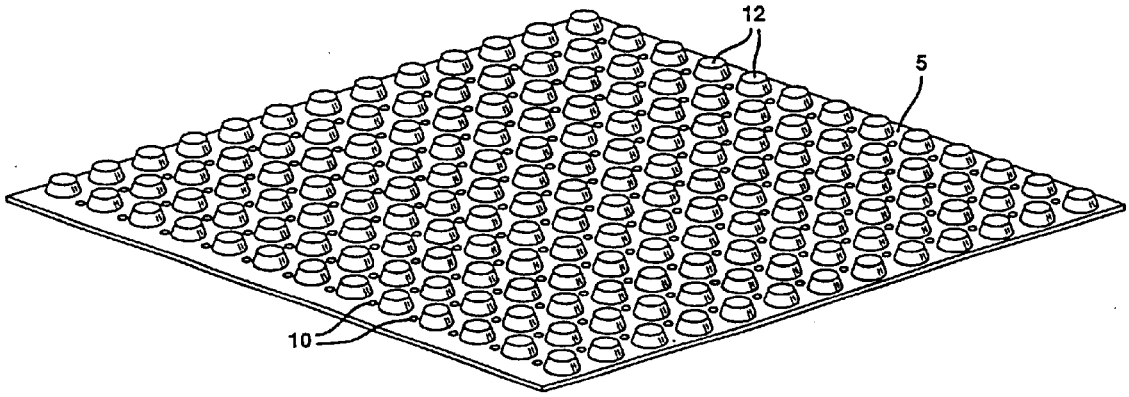
FIG. 4 is a perspective view of the front side of the drainage mat.
Figure 5:
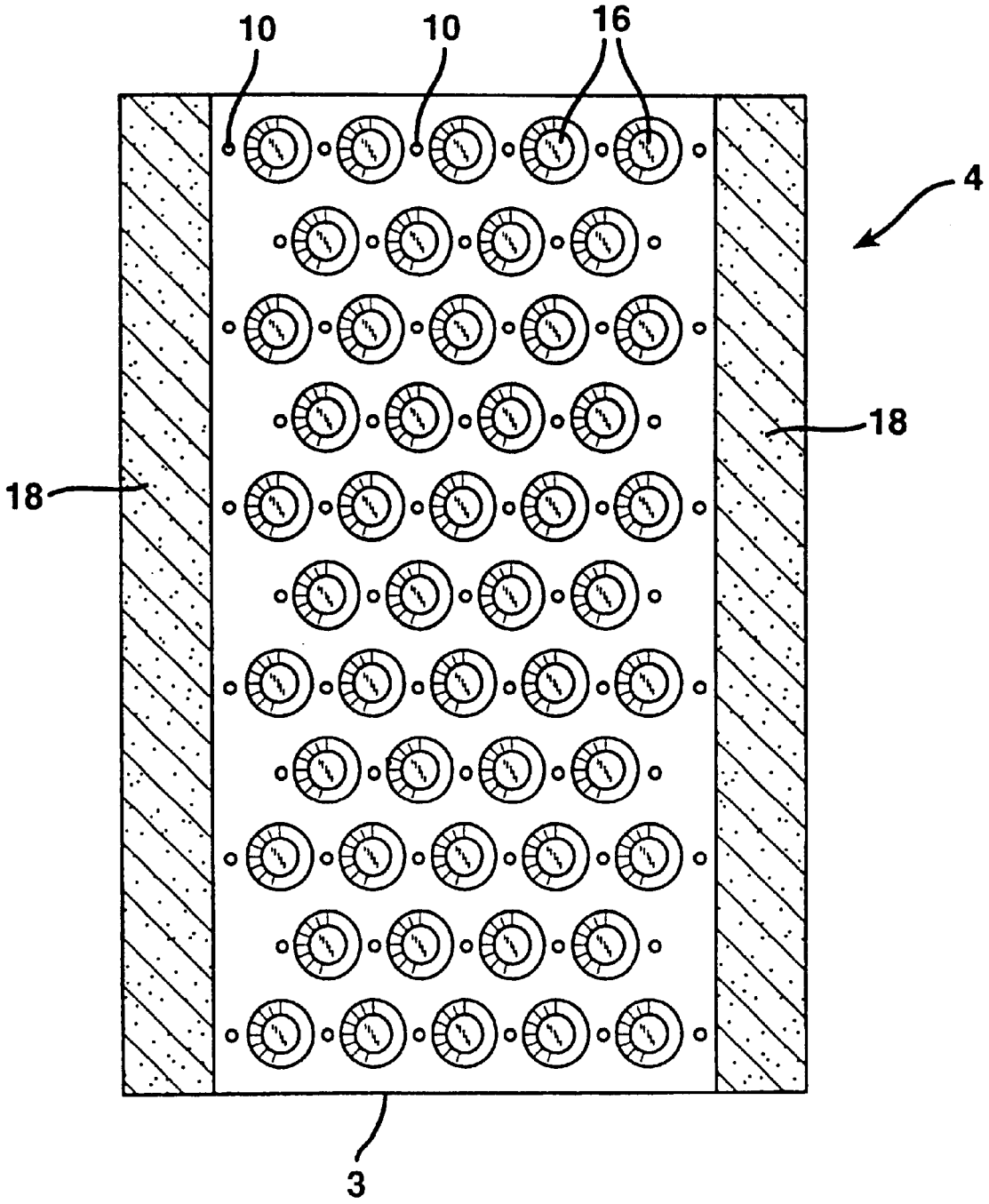
FIG. 5 is a front view of the back side of the drainage mat.

Drainage mat 4 is more clearly illustrated in FIGS. 3 and 4. FIG. 4 shows the front side 5 of the drainage mat 4. Drainage mat 4 may be constructed of any flexible material that is impervious to water including thermoplastic materials. The preferred material used for the drainage mat is high density polystyrene. Drainage mat 4 contains protrusions 12 with apertures 10 randomly positioned between the protrusions 12. FIG. 5 shows the back side 3 of drainage mat 4. Depressions 16 on the back side 3 of the drainage mat 4 correspond with the protrusions 12 of the front side 5 of the drainage mat 4 (FIG. 4). As shown in FIGS. 1 and 3, filter fabric 18 is affixed, by an adhesive, to protrusions 12 on the front side 5 of the drainage mat 4. Filter fabric 18 may be any suitable material which is pervious to water but impervious to solids. In a preferred embodiment, the filter fabric is constructed of polypropylene however, other materials suitable for a filter fabric include polyester and polyethylene. In FIG. 3, filter fabric 18 is pulled back for illustration purposes only. As illustrated in FIG. 1, the filter fabric 18 extends over the edge 11 of the bottom portion 20 on the back side 3 of the drainage mat.

Figure 2:
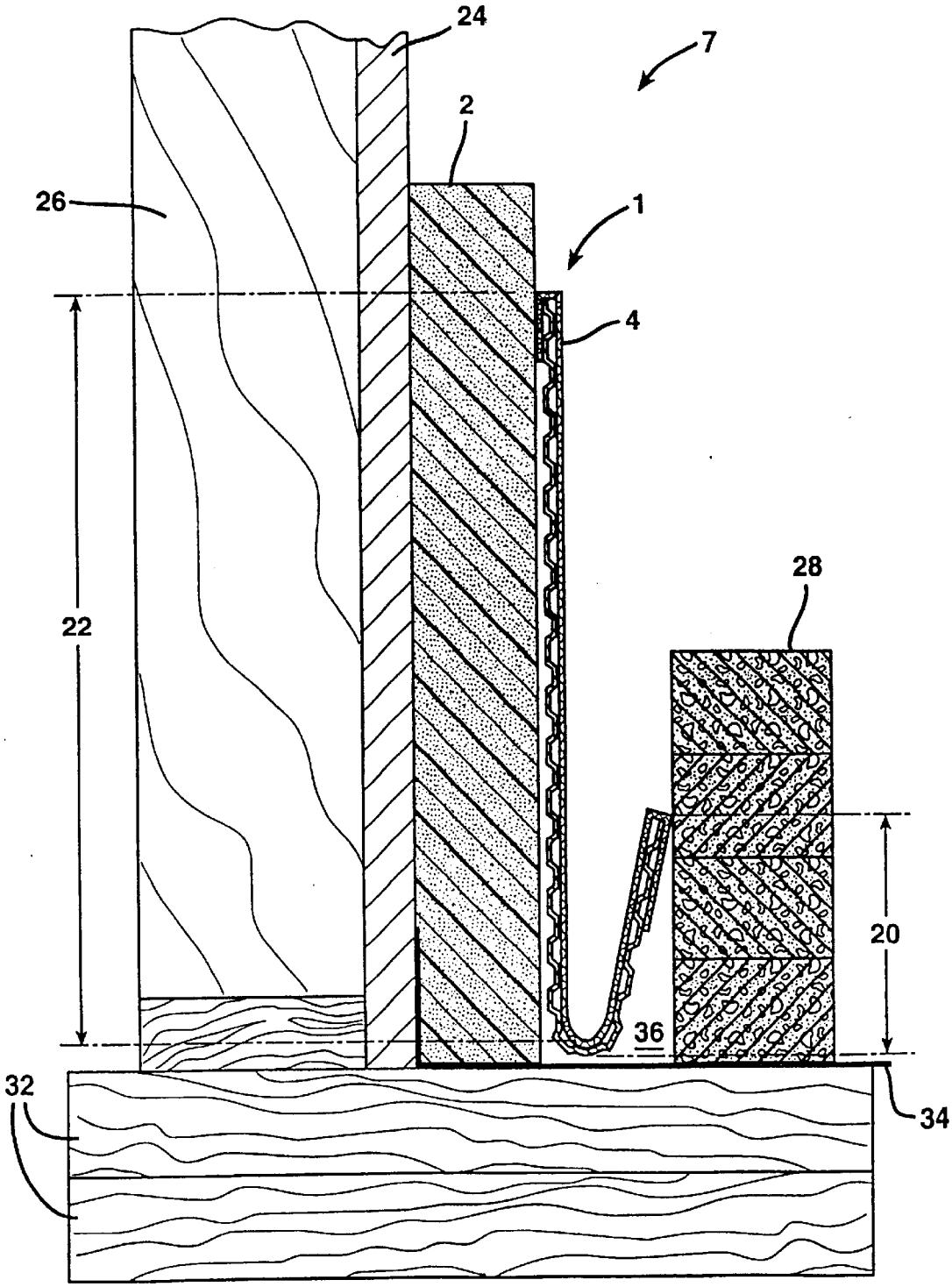
FIG. 2 is a side view of the drainage and mortar blocker as installed in a typical wall cavity.

As shown in FIGS. 1 and 2, drainage mat 4 may be affixed to a panel 2. The panel may be constructed of any suitable material that can be easily affixed to a wall and/or provide insulation to a wall including, but not limited to, fibrous material such as glass fibers and cellulose fibers, composite materials, plywood or gypsum sheathing, expanded polystyrene rigid insulation, extruded polystyrene rigid insulation or polyisocyanurate rigid insulation. In the present invention, the preferred panel is an expanded polystyrene foam insulation board, such as that found in commonly-owned U.S. Pat. No. 6,268,046, which is hereby incorporated by reference.

Turning to FIGS. 1, 3 and 4, drainage mat 4 includes a top portion 22 and a bottom portion 20. As illustrated in FIG. 1, the top portion 22 is affixed a panel 2 by any conventional means, such as an adhesive. It should be noted, however, that the drainage mat does not have to be affixed to a surface, the mat may simply rest in a wall cavity. The bottom portion 20 of the back side 3 of drainage mat 4 is folded upwardly adjacent from said top portion 22 of the panel 2. For the purposes of this invention, the term "adjacent" has the meaning close to, next to, lying near, contiguous or adjoining. In a preferred embodiment, the bottom portion 20 forms a U-shape. Connections such as sewing, staples, string, tape, ties, weak adhesives and any other material capable of retaining the fold, which may be easily severed, may be used. Preferably clips 6 are used, which are inserted during manufacture of the mat, extend through the filter fabric 18 on back side 3 of the bottom portion 20 and through the filter fabric 18 and into the front side 5 of the drainage mat 4 thereby retaining the U-shape.

Turning now to FIG. 2, the wall system 7 shows the drainage mat and mortar blocker as it is typically installed in a wall cavity. The drainage mat and mortar blocker may be installed on a panel 2, affixed to the interior wythe 26 itself or simply placed into the wall cavity. The wall system includes an exterior wythe 28, drainage mat and mortar blocker 4, an exterior sheathing 24, flashing 34 and interior wythe 26. All of the components of the wall system 7 are supported by studs 32.

In FIG. 2, the drainage mat and mortar blocker 4 is installed between an interior wythe 26 and exterior wythe 28. In a preferred embodiment, interior wythe 26 may have an exterior sheathing 24 affixed to its exterior surface to prevent water from entering the interior wythe 26. Exterior sheathing 24 can be constructed of any suitable material that is impervious to water including, but not limited to, laminated polymeric material, polymeric films, plywood, gypsum sheathing, and oriented strand board (OSB) sheathing. The interior wythe 26 is typically constructed of wood, plastic, steel, or masonry. In a preferred embodiment, panel 2 is affixed to the exterior sheathing 24 on the interior wythe 26 with the drainage mat 4 facing the exterior wythe 28. The interior and exterior wythe define a wall cavity 36 which may be any width. The present invention can used utilized in any width of wall cavity. In a preferred embodiment, the wall cavity is between about one to about three inches wide. The bottom portion 20 of the drainage mat extends into the bottom of cavity 36 between the exterior wythe 28 panel 2. Flashing 34 extends under exterior wythe 28, the bottom surface of the cavity 36 and under the panel 2.

As shown in FIG. 2, the exterior wythe 28 is partially constructed prior to installing the drainage mat and mortar blocker 4. After the mat and mortar blocker 4 has been installed, construction of the exterior wythe 28 is completed and clips 6 are broken or cut, allowing the bottom portion 20 to release and at least partially abut exterior wythe 28. Alternatively, the drainage mat and mortar blocker can be installed prior to constructing the exterior wythe however, the exterior wythe should be installed one or two courses high before the clips are severed allowing the bottom portion 20 to release.

The exterior wythe in a preferred embodiment is a brick facing, however the drainage mat and mortar blocker will work with any type of facing such as, concrete block or precast concrete panels. As the exterior wythe is being completed, the filter fabric 18 on the drainage mat 4 contains any mortar and debris (not shown) that falls into the cavity 36. The majority of the debris is collected in the bottom, U-shaped, portion 20 of the mat 4.

Although the drainage mat 4 is impervious to debris, water from construction, weather, condensation, and the like, is able pass through the filter fabric 18 and the apertures 10 in the drainage mat. Protrusions 12 permit water from the filter fabric to be pulled by gravity through the apertures 10 into the bottom of the cavity 36 and onto the flashing 34. The water then exits the cavity through weep holes (not shown) in the exterior wythe.

The drainage mat 4 is manufactured in continuous, flat sheets which may be cut according to the amount required for a wall application. The drainage mat 4 is pre-manufactured with filter fabric 18 affixed to the protrusions 12 with adhesive material on the front side 5 of the mat (see FIG. 3). FIG. 5 illustrates the back side 3 of the drainage mat 4 as it is manufactured showing depressions 16 and apertures 10. Filter fabric 18 extends from the front side 5 (not shown) to the back side 3 and is affixed to the edges of the back side of the mat with adhesive. After filter fabric 18 is applied to the drainage mat 4, the drainage mat 4 is folded and secured with clips 6. The mat may be folded either by hand or by mechanical means. The clips 6 may be inserted into the mat by a hand-held device or by mechanical means such as an automated machine. In a preferred embodiment, drainage mat 4 is adhered to the panel 2 with an adhesive during the final step of manufacture. However, the mat may be affixed to the panel during installation of the mat into the wall cavity as well.

It is possible that changes in configurations to other than those shown could be used but that which is shown is preferred and typical. It is therefore understood that although the present invention has been specifically disclosed with the preferred embodiment and examples, modifications to the design concerning sizing and shape will be apparent to those skilled in the art and such modifications and variations are considered to be equivalent to and within the scope of the disclosed invention and the appended claims.

What is claimed is:

1. A drainage and mortar blocker comprising:

a) a drainage mat comprising apertures wherein said drainage mat has a front and a back side each comprising a top and a bottom portion wherein said front side comprises a filter fabric, wherein said bottom portion is displaced to extend upwardly juxtaposed said top portion to form a channel for collecting fallen debris.

2. The apparatus of claim 1 further comprising a panel of foam insulation board adhered to said back side of the top portion.

3. The apparatus of claim 1 wherein said drainage mat is constructed of high-density polyethylene.

4. The apparatus of claim 1 wherein said bottom portion of said drainage mat extends upwardly adjacent said top portion in a U-shape.

5. The apparatus of claim 4 wherein said U-shape is maintained by connections.

6. The apparatus of claim 5 wherein said connections extend through said back aide of said bottom portion of said drainage mat and into said front side of said drainage mat.

7. The apparatus of claim 1 wherein said drainage mat further comprises protrusions on said front side of said drainage mat.

8. The apparatus of claim 7 wherein said back side of said drainage mat comprises depressions corresponding to said protrusions on said front side of said drainage mat.

9. The apparatus of claim 7 wherein said filter fabric is affixed to said protrusions.

10. The apparatus of claim 7 wherein said apertures are randomly spaced between said protrusions.

11. The apparatus of claim 9 wherein said filter fabric is a water pervious polypropylene sheet.

12. The apparatus of claim 2 wherein said panel is affixed to an interior wythe.

13. The apparatus of claim 12 wherein at least a part of said bottom portion of said drainage mat contacts an exterior wythe.

14. The apparatus of claim 13 wherein said exterior wythe is a brick wall.

15. The apparatus of claim 12 wherein said bottom portion of said drainage mat collects fallen debris from construction of said exterior wythe.

16. The apparatus of claim 15 wherein said debris is mortar.

17. A method for producing a drainage and mortar blocker comprising the steps of:

a) providing a drainage mat comprising apertures wherein said drainage mat has a front and a back side each comprising a top and a bottom portion and wherein said front side comprises a filter fabric;

b) bending said bottom portion of said mat so that said bottom portion of said mat extends juxtaposed said top portion forming a channel for the collection of fallen debris; and c) connecting said bottom portion to said top portion of said drainage mat.

18. The method of claim 17 further comprising attaching a panel of foam insulation board to said back side of said top portion.

19. The method of claim 17 wherein said drainage mat is constructed of high density polyethylene.

20. The method of claim 17 further comprising the step of forming a U-shape.

21. The method of claim 20 wherein said U-shape is maintained by said connections.

22. The method of claim 17 wherein said drainage mat further comprises protrusions on said front side of said drainage mat.

23. The method of claim 22 wherein said back side of said drainage mat comprises depressions corresponding to said protrusions on said front side of said drainage mat.

24. The method of claim 22 wherein said filter fabric is affixed to said protrusions.

25. The method of claim 22 wherein said apertures are randomly spaced between said protrusions.

26. The method of claim 17 wherein said filter fabric is a water pervious polypropylene sheet.

27. The method of claim 18 wherein said panel is affixed to an interior wythe.

28. The method of claim 17 wherein at least a part of said bottom portion of said drainage mat contacts an exterior wythe.

29. The system of claim 28 wherein said exterior wythe is a brick wall.

30. The system of claim 17 wherein said bottom portion of said drainage mat collects fallen debris from construction of said exterior wythe.

31. The system of claim 30 wherein said debris is mortar.

32. A method of installing a drainage and mortar blocker in a wall cavity comprising the steps of:

a) providing a drainage mat comprising apertures wherein said drainage mat has a front and a back side each comprising a top and a bottom portion wherein said front side comprises a filter fabric;

b) connecting said bottom portion and said top portion of said drainage mat wherein said bottom portion extends upwardly adjacent said top portion;

c) providing an interior wythe having an exterior surface;

d) providing an exterior wythe having an interior surface;

e) affixing said drainage mat and mortar blocker on said exterior surface of said interior wythe;

f) severing said connections so that said bottom portion of said drainage mat at least partially abuts said interior surface of said exterior wythe.

33. The method of claim 32 further comprising the step of attaching a panel of foam insulation board to said back side of said top portion.

34. The method of claim 32 wherein said drainage mat is constructed of high-density polyethylene.

35. The method of claim 32 wherein said bottom portion of said drainage mat extends upwardly and away from said interior wythe in a U-shape.

36. The method of claim 35 wherein said U-shape is maintained by said connections.

37. The method of claim 32 wherein said drainage mat further comprises protrusions on said front side of said drainage mat.

38. The method of claim 37 wherein said back side of said drainage mat comprises depressions corresponding to said protrusions on said front side of said drainage mat.

39. The method of claim 38 wherein said filter fabric is affixed to said protrusions.

40. The method of claim 38 wherein said apertures are randomly spaced between said protrusions.

41. The method of claim 39 wherein said filter fabric is a water pervious polypropylene sheet.

42. The method of claim 32 wherein said exterior wythe is a brick wall.

43. The method of claim 32 wherein said bottom portion of said drainage mat collects fallen debris from construction of said exterior wythe.

44. The method of claim 43 wherein said debris is mortar.

45. The method of claim 32 wherein said interior wythe and said exterior wythe define a wall cavity having a width.

46. The method of claim 45 wherein said width of said wall cavity is between about one to about three inches.

* * * * *